US006028619A

United States Patent [19]

Saita et al.

[11] Patent Number: 6,028,619

[45] Date of Patent: Feb. 22, 2000

[54] THERMAL HEAD

[75] Inventors: Yoshiaki Saita; Osamu Takizawa, both of Chiba, Japan

[73] Assignee: Seiko Instruments Inc., Japan

[21] Appl. No.: 08/944,662

[22] Filed: Oct. 6, 1997

[51] Int. Cl.[7] ..... B41J 2/335; B41J 2/34

[52] U.S. Cl. ..... 347/209; 347/210

[58] Field of Search ..... 347/200, 209, 347/210, 201, 202

[56] References Cited

U.S. PATENT DOCUMENTS 4,689,638 8/1987 Matsuzaki et al. ..... 347/202

FOREIGN PATENT DOCUMENTS 62-255163 11/1987 Japan .

*Primary Examiner*—Huan Tran

*Attorney, Agent, or Firm*—Adams & Wilks

[57] ABSTRACT

A thermal head comprises a substrate having a main surface bounded by a peripheral edge, an electrode formed on the surface of the substrate, and a heater disposed on the surface of the substrate and electrically connected to the electrode. A driver IC is disposed on the surface of the substrate and is electrically connected to the electrode for providing a drive signal to drive the heater. An encapsulation element is disposed over the IC for protecting the IC. The encapsulation element has a surface portion which extends to the peripheral edge of the substrate.

22 Claims, 5 Drawing Sheets

THERMAL HEAD

BACKGROUND OF THE INVENTION

The present invention relates to a thermal head for use in a facsimile machine, a printer, a portable apparatus, and the like, and to a method of manufacturing the same.

FIG. 11 is a sectional view illustrating a structure of a conventional thermal head. Generally, in the conventional thermal head, a heater 2, an electrode 3, and a protective film 4 are formed on a plate-like substrate 7 made of glazed ceramic or the like, and a driver IC 5 whose terminals are connected to the electrode 3, and an encapsulation 6 for protecting the IC are provided thereon. The encapsulation 6 is prepared such that silicon resin, epoxy resin or the like is coated to the IC, and then is subjected to curing. Further, in FIG. 11, although the driver IC is mounted by wire bonding, there is also a case where the driver IC is mounted according to what is called the face-down method. The heater, the electrode, and the protective film on the thermal head substrate are formed by a thick film process, a thin film process, and a photolithographic process, which are all costly. Thus, usually, a plurality of thermal heads are laid out on a large wafer such that a plurality of thermal heads are manufactured simultaneously by processing one wafer. Since, as mentioned the above, the process is costly, in view of the manufacturing cost, it is desirable that as many as possible thermal heads are laid out on a large wafer.

On the other hand, a facsimile machine, a printer, and the like, especially those used in the field of portable apparatus, are now being miniaturize and the overall weight reduced. In view of the trend toward miniaturizing and reducing the weight of the apparatus, miniaturization of a thermal head for use in the apparatus is also required.

In the context mentioned above, in order to get a greater number of thermal heads from one wafer, a thermal head is required to be sized smaller with the limitations mentioned above.

Moreover, in a schematic sectional view of a driver IC mounting portion of a thermal head as shown in FIG. 12, a width 8 of the encapsulation 6 for protecting the IC has a smallest necessary value, i. e., the width 8 can not be made smaller than a width 9 of the IC. Further, since the encapsulation is carried out by coating and curing the resin, due to flowing out of the resin before curing shown by a dotted line in FIG. 12, the width of the encapsulation becomes wider than that at the time of coating.

Therefore, conventionally, as a method to prevent the encapsulant from flowing out of the encapsulant and to suppress the width of the encapsulation to a narrower range, there is a known method shown in FIG. 13 of providing a dike-like frame 6*a* with resin having high viscosity and thus being less likely to flow out around an IC mounted by wire bonding in advance. By this method, resin 6*b* has a low viscosity flow within the frame 6*a* to protect the upper portion, edges, and wire of the IC, and then curing the resin. In case of an IC mounted according to the face-down method, a method basically similar to this is also carried out.

However, a thermal head with a conventional sealing structure as mentioned above has the following problem:

(1) Without a frame, it is difficult to accurately position the edges of the encapsulation due to flowing out of the resin;

(2) It is difficult to accurately position the frame, since the frame for avoiding flowing out of the encapsulant is also made of resin;

(3) If the frame is formed close to the IC for the purpose of reducing the width 8 of the encapsulation, since the frame material has high viscosity, intricate portions of the IC can not be filled with the resin, and therefore, the width 8 of the encapsulation has to be extended outwardly from the IC or the wire by the width 10 of the frame or more.

SUMMARY OF THE INVENTION

Accordingly, an object of the present invention is to solve the problems of a conventional thermal head mentioned above and to materialize further miniaturization of a thermal head by making encapsulation smaller by means of bringing an edge of the encapsulation to the limit of the mounting portion.

According to the present invention, there is provided a thermal head comprising a substrate with a heater formed thereon, a driver IC mounted on the substrate for providing a drive signal for the heater, and encapsulation for protecting the IC, wherein at least a part of the encapsulation has a surface cut in separation. By cutting and separating two lines of simultaneously formed IC encapsulation portions, flowing out of the encapsulant on the side opposite to the heater is prevented, the accuracy of positioning the edge of the encapsulation on the side opposite to the heater is easily secured, and at the same time, a contribution is made to miniaturization of the thermal head.

Here, although it is still necessary to secure accuracy of positioning the encapsulation on the side of the heater, since the accuracy of positioning the encapsulation on the side of the heater is secured just by securing clearance from a platen roller, this can be controlled easier than that on the side opposite to the heater.

Further, the thermal head according to the present invention can be manufactured by a method for manufacturing a thermal head comprising the steps of preparing a large substrate, a plurality of electrodes for mounting driver ICs being laid out thereon symmetrically with respect to separating lines of thermal heads adjacent to each other, mounting driver ICs on the electrodes for mounting driver ICs, filling with encapsulation resin IC mounting portions of a plurality of thermal heads adjacent to each other on the large substrate, forming grooves in at least one of an encapsulation resin portion and the back of the substrate, and separating the substrate into individual thermal heads using the grooves. According to the manufacturing method described above, two lines of encapsulations can be carried out simultaneously, leading to shorter time necessary for the sealing.

DETAILED DESCRIPTION OF THE PREFERRED EMBODIMENTS

Embodiments of the present invention are now described with reference to the drawings.

Figure 1:
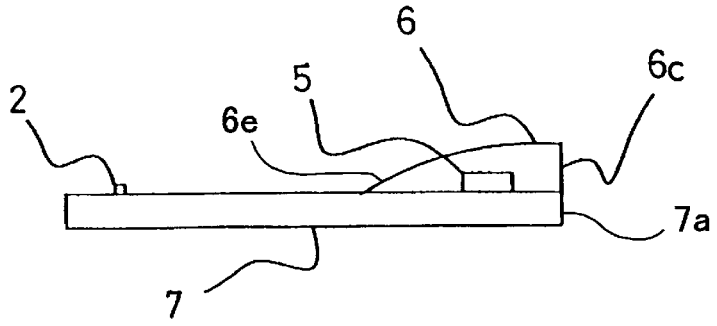
FIG. 1 is a sectional view of a thermal head of the present invention manufactured according to the face-down mounting method.

FIG. 1 is a sectional view of a thermal head of the present invention. A heater 2 is formed on a substrate 7. An IC 5 for driving the heater is mounted according to the face-down method such that the element face is oriented to the side of the substrate 7. Further, encapsulation 6 defining a sealing portion for protecting an IC mounting portion is formed. It is to be noted that other composing elements of the thermal head, such as an electrode and a protective film, are not shown in the figure.

In FIG. 1, a frame is not provided for the encapsulation 6, and a portion 6*e* of the encapsulation 6 on the side of the heater 2 is shaped like gentle lower slopes of a mountain due to natural flowing out of sealing resin. On the other hand, an encapsulation portion 6*c* of the encapsulation 6 on the side opposite to the heater is shaped like a steep cliff. The cliff-shaped portion is almost just above a peripheral edge 7*a* of the substrate 7, and has a surface portion extending to the peripheral edge 7*a*, i.e., the encapsulation 6 does not protrude outwardly over the substrate. More specifically, the surface portion of the encapsulation part 6*c* is contiguous with the peripheral edge 7*a* of the substrate 7. Such a cliff-shaping process can make the IC in proximity to the edge of the substrate, and therefore, is wasteless.

If only a part of the encapsulation on the side opposite to the heater is processed to be cliff-shaped, effects of the present invention can be enjoyed. The height of the encapsulation cliff portion 6*c* is 0.1 mm to 1.5 mm. The distance between the junction of an IC connecting terminal and an electrode and the cliff portion is at least partly in a range of 0.1 mm to 1.7 mm. The distance between the cliff portion and the edge of the chip on the side of the cliff is 0.1 mm to 1.5 mm in case of the face-down method and is 0.6 mm to 2.2 mm in case of wire bonding.

Figure 2:
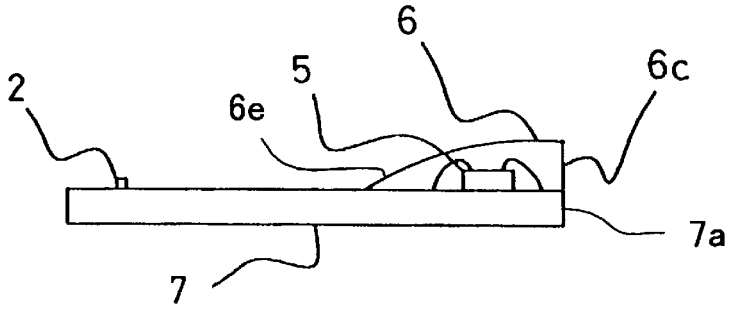
FIG. 2 is a sectional view of a thermal head of the present invention manufactured according to the wire bonding mounting method.

FIG. 2 is a sectional view of a thermal head with an IC mounted by wire bonding. The thermal head can be grooved and separated similarly to the case mentioned above. However, in this case, since additional space is necessary for the wire, the distance between the edge of the IC and the edge of the substrate is extended by that space necessary for the wire, i.e., on the order of 0.5 mm.

Figure 3:
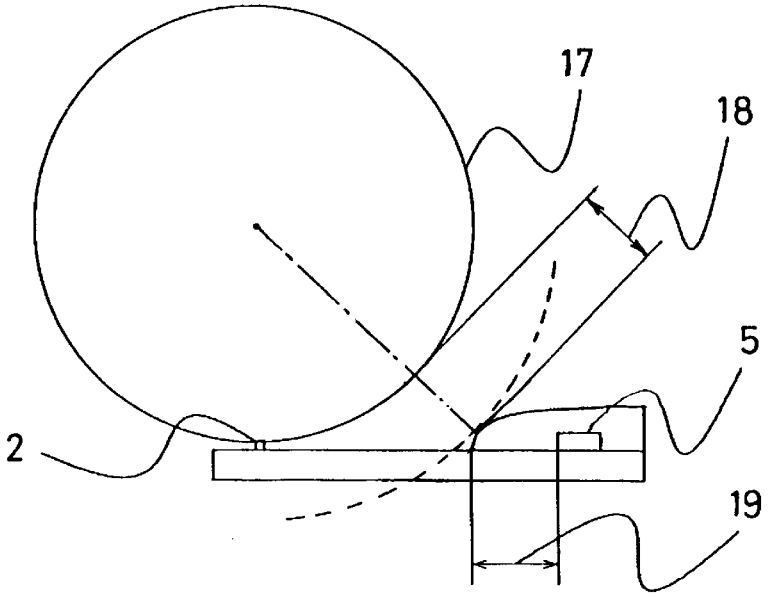
FIG. 3 is an explanatory view of clearance between a platen roller and an encapsulation portion of the present invention.

Here, as shown in FIG. 3, minimum clearance 18 provided between a platen roller 17 and the encapsulation portion is generally on the order of 0.5 to 1 mm. Further, the encapsulation is not so high over a distance 19 between the edge of the IC and the edge of the encapsulation (the lower slopes of the sealing that flows out). Thus, even the flowing out of the encapsulant remains natural on the side of the heater, no problem arises with respect to the minimum clearance 18 from the platen roller.

Figure 4:
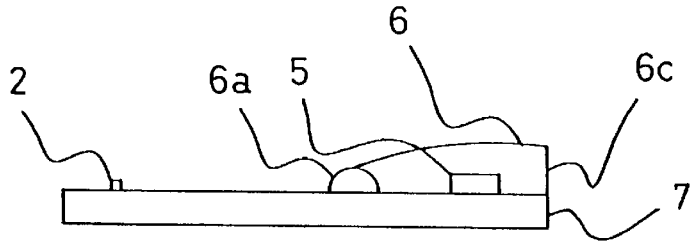
FIG. 4 is a sectional view of a thermal head in which encapsulation is carried out with a frame on a mounting portion of an IC mounted according to the face-down method.

However, in case the encapsulant flows out to a great extent on the side of the heater to interfere with the heater, the amount of the flowing out can be easily controlled if a frame 6*a* as shown in FIG. 4 is formed of an encapsulant having high viscosity, a solder resist, or the like.

Also, in case the IC is mounted by wire bonding, if the encapsulant flows out to a great extent, provision of the frame mentioned above makes it easy to control the amount of the encapsulant that flows out.

Embodiments of a method of manufacturing a thermal head according to the present invention are now described in the following.

Figure 5:
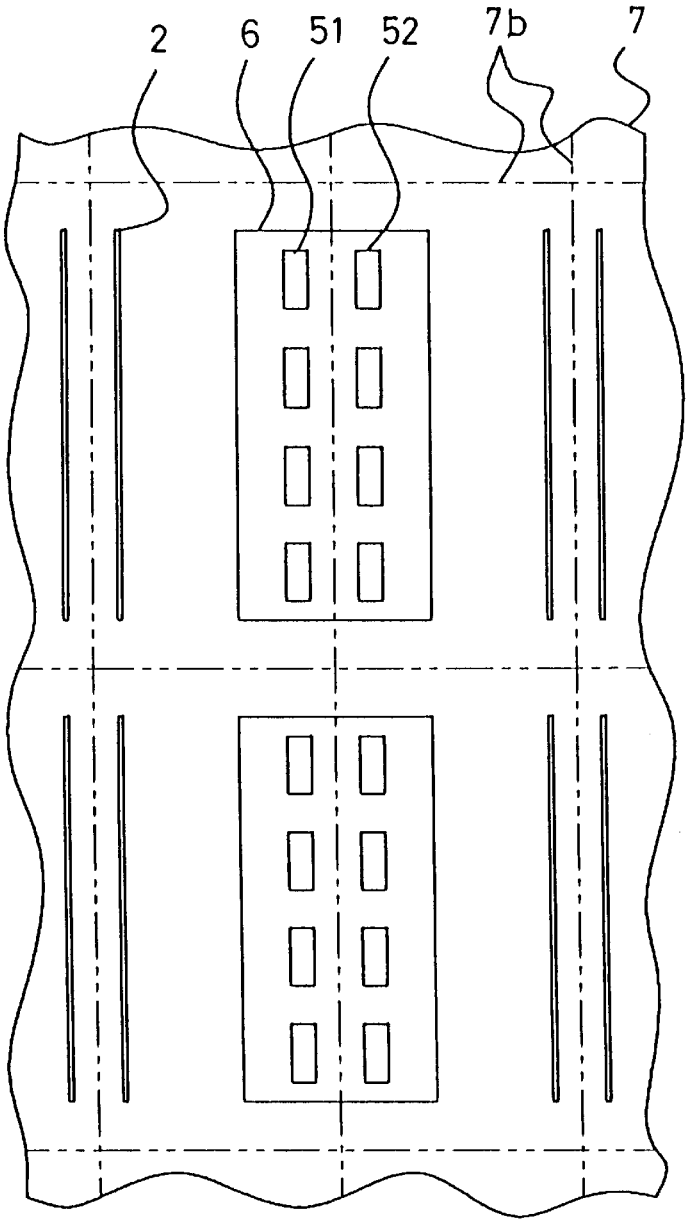
FIG. 5 is a partial schematic view illustrating a state where a plurality of thermal heads are laid out on a wafer of the present invention.

FIG. 5 is a top view of a part of a large substrate. In the figure, electrodes and a protective film are not shown.

Heaters 2, the electrodes, and the protective film are formed on a large wafer 7 made of glazed ceramic or the like such that a plurality of thermal heads are formed. The plurality of thermal heads are laid out such that each of the heaters 2 faces another heater.

The number of the thermal heads laid out on the large wafer 7 depends on the size of the wafer and the size of a single thermal head. For example, three pairs of thermal heads each of which have two heaters facing each other, that is, six lines of thermal heads are laterally formed, and thermal heads the number of which is in accordance with the length of the thermal heads (in other words, the length of the heaters) are longitudinally formed. In this way, a plurality of thermal heads are laid out in one wafer.

When ICs are mounted on such a large substrate, the protective film is removed at least with regard to portions where the ICs are mounted. The position where an IC is mounted is on the side opposite to an end portion where a heater 2 is formed in a single thermal head (that is, a region which is sectioned off by laser-scribed grooves 7*b*), and the ICs are mounted in a line along a longitudinally scribed groove 7*b*.

Figure 6:
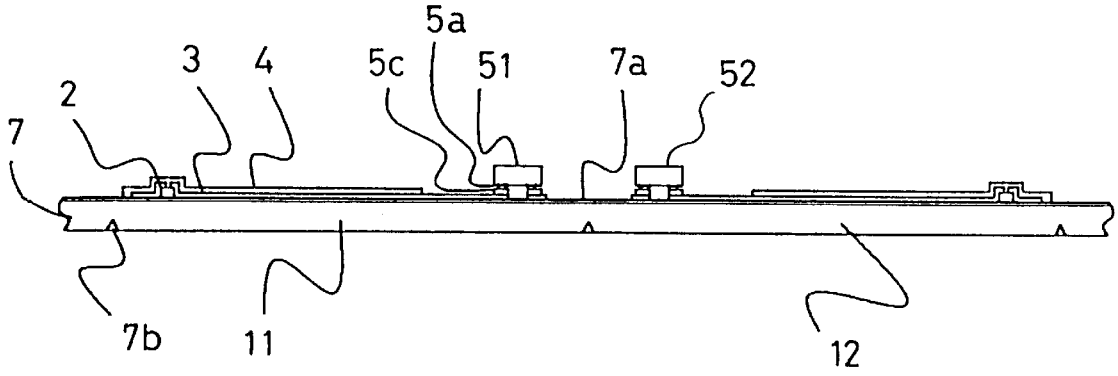
FIG. 6 is a sectional view illustrating a state where ICs are mounted on a large wafer according to the face-down mounting method using resin containing conductive particles.

FIG. 6 is a sectional view of a large wafer on which ICs are mounted. An IC 5 is provided with a circuit face or a terminal 5*a* in a downward direction of the figure. Resin 5*c* in which conductive particles are dispersed electrically connects the terminal 5*a* of the IC 5 with an electrode 3, and at the same time, fixes the IC on the substrate.

The physical relationship between ICs and between heaters of thermal heads 11 and 12 adjacent to each other is that the thermal heads 11 and 12 are symmetrically disposed with respect to the boundary edge, and the ICs mounted on the respective thermal heads are adjacent to each other. Here, it is sufficient that the space between the ICs is on the order of 1 mm, and, depending on the accuracy of the subsequent processes mentioned below and reliability of a sealing agent, the space may be on the order of 0.5 mm.

In a process of mounting the IC, in case the circuit face or the terminal 5*a* of the IC 5 in the downward direction is formed by soldering, the terminal 5*a* of the IC 5 may be electrically connected with the electrode 3 by soldering and the IC may be fixed on the substrate at the same time.

Figure 7:
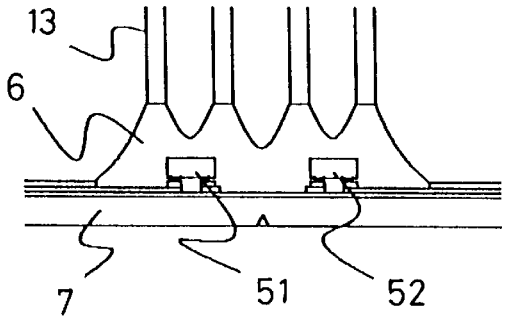
FIG. 7 is an explanatory view of a process of encapsulation on the ICs according to the present invention.

FIG. 7 illustrates a process of encapsulation of the ICs. A plurality of nozzles 13 seals both ICs 51 and 52 adjacent to each other in the direction from the front to the back of the drawing (or in the reverse direction) without a stop, expelling encapsulation resin extending over the ICs 51 and 52. The space between the ICs 51 and 52 adjacent to each other is filled with the encapsulation resin 6. In this way, space between ICs on the order of 1 mm to 0.5 mm can be extremely easily filled up. The filling resin is cured by heat treatment. The process of encapsulation mentioned above is commonly used irrespective of the method of mounting the ICs.

Figure 8:
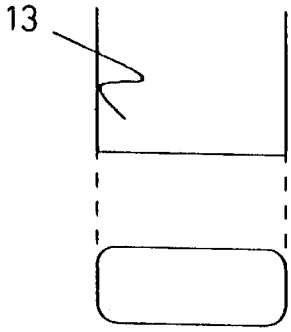
FIG. 8 is an explanatory view of nozzles for encapsulation on the ICs according to the present invention.

Further, if the nozzle 13 is shaped to be rectangular, as shown in FIG. 8, the number of the nozzles can be reduced.

Figure 9:
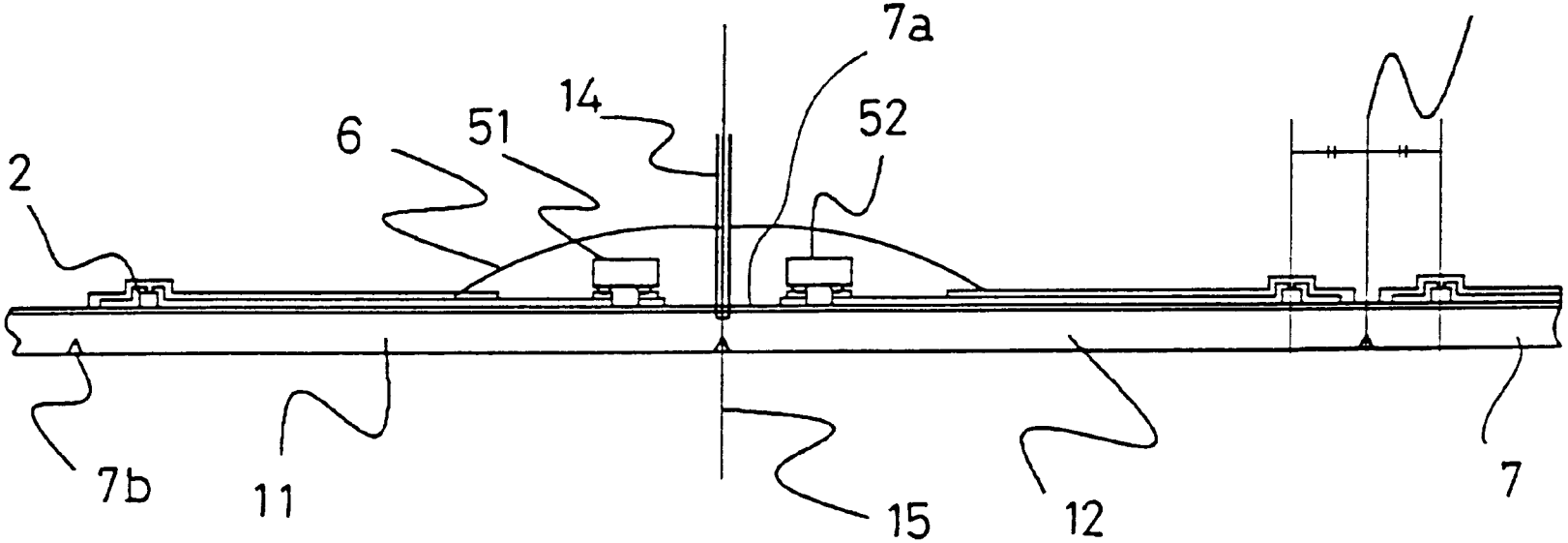
FIG. 9 is an explanatory view of a process of forming grooves in encapsulation resin according to the present invention.

FIG. 9 illustrates a process of forming grooves in the cured encapsulation resin 6 for separating the ICs. In the process of forming grooves, an apparatus such as a dicing saw or a slicer is used, and the grooves are formed with a grooving tool such as a blade provided for the apparatus.

A blade 14 forms a groove which is on the order of 0.1–0.3 mm in width and which is as deep as a glaze layer 7*a* of the large wafer 7 between the ICs 51 and 52 of the thermal heads adjacent to each other. FIG. 9 shows a state where the process of forming a groove between the two thermal heads 11 and 12 is progressing. The distance between a wall of the groove in the resin for encapsulation formed with the blade and the edge of the IC inside, that is, the thickness of the resin at the edge of the thermal head is on the order of 0.2–0.5 mm. The resin being about this thick is sufficient for ensuring the reliability. Even if the edge of the IC is exposed, since the circuit portion of the IC is more than several dozens microns inside, no problem arises with respect to the reliability.

Then, the wafer is separated along the laser-scribed grooves 7*b* formed on the back of the large wafer along virtual separating lines. Further, the wafer is separated along heater center lines 16 adjacent to the heaters to obtain a single thermal head.

Figure 10:
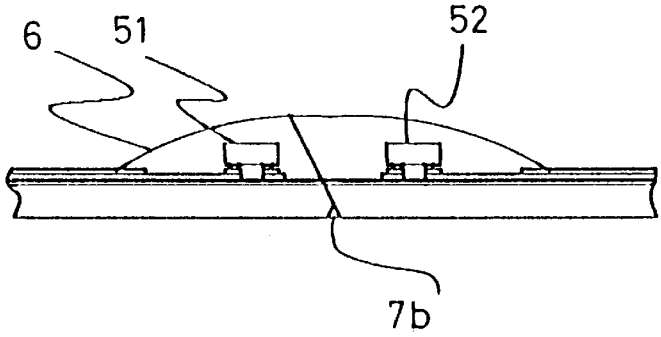
FIG. 10 is a sectional view illustrating an example of a surface cut in separation in case a process of forming grooves is not carried out with respect to the resin according to the present invention.
Figure 11:
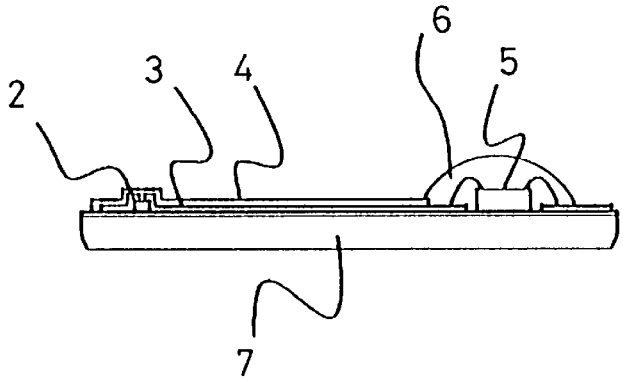
FIG. 11 PRIOR ART
FIG. 11 is a sectional view of a conventional thermal head.
Figure 12:
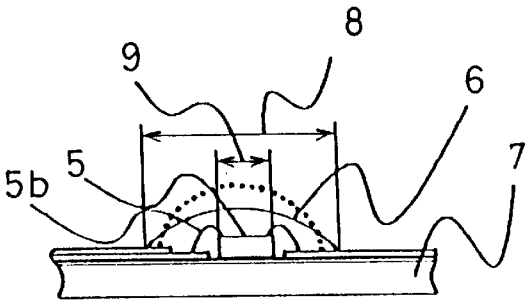
FIG. 12 PRIOR ART
FIG. 12 is a sectional view of an encapsulation portion illustrating change in the shape of the encapsulation before curing and after curing.
Figure 13:
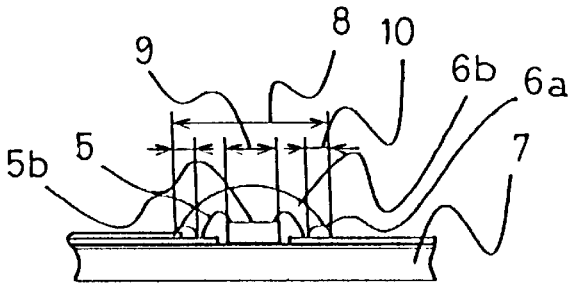
FIG. 13 PRIOR ART
FIG. 13 is a sectional view of an encapsulation portion of an IC prepared according to the wire bonding mounting method using conventional encapsulation with a frame.

Alternatively, the wafer may be separated using the laser-scribed grooves 7*b* without the process of forming the grooves in the encapsulation resin portion. In this case, although the section of the separated wafer may slant as shown in FIG. 10, if the space between ICs adjacent to each other is 0.5 mm or more, no problem arises with respect to the reliability.

Further, the grooves formed in the encapsulation resin with the blade or the like mentioned in the above may be as deep as a resin layer just above the glaze layer, and still the wafer can be separated. To the contrary, if the grooves are formed so as to reach the substrate (below the glaze layer), the wafer can be separated utilizing the grooves reaching the substrate even if the laser-scribed grooves are not formed on the back of these portions.

With the processing method of the present invention described in the above, the distance between the edge of an IC and the edge of the substrate on the side of the IC is on the order of 0.3 mm. Since the distance between a heater and the edge of the substrate on the side of the heater, the distance between the heater and the edge of the IC, and the width of the IC are about 0.5 mm, 3.7 mm, and 0.6 mm, respectively, a microminiaturized thermal head on the order of 5.1 mm can be materialized.

As described, according to thermal heads a number of which is gotten from one wafer of the present invention, since the thermal heads are laid out such that the ICs of the thermal heads are adjacent to each other, a group of the ICs are collectively sealed, and then the wafer is separated along the center lines of the encapsulation portions, the thermal heads can be miniaturized.

According to the method of manufacturing a thermal head of the present invention, since ICs of a plurality of thermal heads are laid out so as to be adjacent to each other, ICs of thermal heads adjacent to each other are simultaneously encapsuled with resin, thereby reducing the manpower for encapsulation and materializing miniaturization of the thermal heads.

Further, using a multineedle or a noncircular deformed needle in a process of coating encapsulation resin makes it possible to further reduce the manpower.

Still further, by separating the wafer into individual thermal heads utilizing half cut or complete cut of the encapsulation resin with a slicer or a dicing saw, or utilizing laser-scribed grooves on the back of the substrate, a thermal head of high reliability can be prepared with reduced manpower.

In this way, according to the present invention, a thermal head can be miniaturized, two lines of ICs can be simultaneously sealed, an encapsulant with low thizotropy can be used, and the present invention can be applied to various methods of mounting an IC. In this way, a thermal head with high productivity and low cost can be provided.

What is claimed is:

1. A thermal head comprising: a substrate having a peripheral edge; a heater formed on the substrate; a driver IC mounted on the substrate for providing a drive signal to drive the heater; and a sealing element disposed over the IC for protecting the IC, at least a part of the sealing element having a surface portion contiguous with the peripheral edge of the substrate.

2. A thermal head as claimed in claim 1; wherein the surface portion of the sealing element is cliff-shaped and has a height in the range of 0.1 mm to 1.5 mm.

3. A thermal head as claimed in claim 2; wherein the cliff-shaped surface portion of the sealing element does not protrude over the peripheral edge of the substrate.

4. A thermal head as claimed in claim 3; wherein the surface portion of the sealing element is flat.

5. A thermal head as claimed in claim 2; wherein the surface portion of the sealing element is flat.

6. A thermal head as claimed in claim 1; wherein a distance between an electrode portion where the driver IC is electrically connected with the substrate and the surface portion of the sealing element is in the range of 0.1 mm to 2.2 mm.

7. A thermal head as claimed in claim 1; wherein the surface portion of the sealing element is flat.

8. A thermal head comprising: a substrate having a main surface bounded by a peripheral edge; an electrode formed on the main surface of the substrate; a heater disposed on the main surface of the substrate and electrically connected to the electrode; a driver IC disposed on the main surface of the substrate and electrically connected to the electrode for providing a drive signal to drive the heater; and an encapsulation element disposed over the IC for protecting the IC, the encapsulation element having a surface portion extending to the peripheral edge of the substrate.

9. A thermal head as claimed in claim 8; wherein the surface portion of the encapsulation element is generally cliff-shaped.

10. A thermal head as claimed in claim 9; wherein the surface portion of the encapsulation element has a height from the main surface of the substrate in the range of 0.1 mm to 1.5 mm.

11. A thermal head as claimed in claim 9; wherein the surface portion of the encapsulation element is flat.

12. A thermal head as claimed in claim 8; wherein the surface portion of the encapsulation element has a height from the main surface of the substrate in the range of 0.1 mm to 1.5 mm.

13. A thermal head as claimed in claim 8; wherein a distance between a portion of the electrode to which the IC driver is electrically connected and the surface portion of the encapsulation element is in the range of 0.1 mm to 1.7 mm.

14. A thermal head as claimed in claim 8; wherein the surface portion of the encapsulation element does not protrude over the peripheral edge of the substrate.

15. A thermal head as claimed in claim 14; wherein the surface portion of the encapsulation element is flat.

16. A thermal head as claimed in claim 8; wherein the encapsulation element comprises a sealing material.

17. In combination with a thermal head having a substrate bounded by a peripheral edge and a driver IC disposed on a main surface of the substrate: an encapsulation element disposed over the IC for protecting the IC, the encapsulation element having a surface portion contiguous with the peripheral edge of the substrate.

18. A combination as claimed in claims 17; wherein the encapsulation element comprises a curved portion, and a flat portion defining the surface portion contiguous with the peripheral edge of the substrate.

19. A combination as claimed in claim 17; wherein the surface portion of the encapsulation element is generally cliff-shaped.

20. A combination as claimed in claim 19; wherein the surface portion of the encapsulation element-has a height from the main surface of the substrate in the range of 0.1 mm to 1.5 mm.

21. A combination as claimed in claim 17; wherein the surface portion of the encapsulation element has a height from the surface of the substrate in the range of 0.1 mm to 1.5 mm.

22. A combination as claimed in claim 17; wherein the encapsulation element comprises a sealing material.

* * * * *